US005950538A

United States Patent [19]

Puschnerat

[11] Patent Number: 5,950,538

[45] Date of Patent: Sep. 14, 1999

[54] PRINTING UNIT HAVING DRIVE MEANS

[75] Inventor: Helmut Puschnerat, Wachenheim, Germany

[73] Assignee: Koenig & Bauer—Albert Aktiengesellschaft, Wurzburg, Germany

[21] Appl. No.: 08/898,128

[22] Filed: Jul. 22, 1997

[30] Foreign Application Priority Data

Jul. 23, 1996 [DE] Germany ..... 196 29 605

[51] Int. Cl.[6] ..... B41F 7/02

[52] U.S. Cl. ..... 101/217; 101/220

[58] Field of Search ..... 101/217, 218, 101/220, 177, 178, 179, 180, 182, 183, 184

[56] References Cited

U.S. PATENT DOCUMENTS

| | | | |
|---|---|---|---|
| 2,022,696 | 12/1935 | Tomlin et al. | 101/220 |
| 4,072,104 | 2/1978 | Schaeffer | 101/248 |
| 4,696,229 | 9/1987 | Bezler et al. | 101/177 |
| 4,753,168 | 6/1988 | Theilacker et al. | 101/177 |
| 4,788,912 | 12/1988 | Fischer | 101/180 |
| 4,934,265 | 6/1990 | Knauer | 101/177 |
| 5,012,735 | 5/1991 | Fischer et al. | 101/177 |
| 5,331,890 | 7/1994 | Miyoshi et al. | 101/177 |
| 5,782,182 | 7/1998 | Ruckmann et al. | 101/177 |

FOREIGN PATENT DOCUMENTS

| | | | |
|---|---|---|---|
| 0 022 381 | 1/1981 | European Pat. Off. | 101/217 |
| 0621133 | 10/1994 | European Pat. Off. . | |
| 0 644 048 | 12/1994 | European Pat. Off. . | |
| 0699524 | 3/1996 | European Pat. Off. . | |
| 2924616 | 1/1981 | Germany . | |
| 44 30 693 | 3/1996 | Germany . | |
| 29608990 | 8/1996 | Germany . | |
| WO95/24314 | 9/1995 | WIPO . | |

*Primary Examiner*—John Hilten
*Assistant Examiner*—Leslie Grohusky
*Attorney, Agent, or Firm*—Jones, Tullar & Cooper, P.C.

[57] ABSTRACT

In a printing unit of an offset rotary printing press with two pairs of plate and rubber blanket cylinders, the first plate cylinder and the two rubber blanket cylinders are mechanically coupled and are driven by a common drive. The second plate cylinder is provided with its own drive.

6 Claims, 2 Drawing Sheets

PRINTING UNIT HAVING DRIVE MEANS

FIELD OF THE INVENTION

The present invention is directed generally to a printing unit. More particularly, the present invention is directed to an offset printing unit in a rotary printing press. Most particularly, the present invention is directed to an offset printing unit having at least two printing cylinders and two transfer cylinders. The two transfer cylinders and one of the printing cylinders are mechanically, interlockingly coupled to each other and are driven by a common drive. The second printing cylinder is provided with its own drive. The printing unit allows either of the printing cylinder drives to act as the common drive for itself and also for the two transfer cylinders. A simplified printing unit with easier circumferential register adjustment is accomplished.

DESCRIPTION OF THE PRIOR ART

In the field of rotary printing, it is well known to utilize printing cylinders and transfer cylinders to accomplish offset printing. The printing cylinders are typically plate cylinders and the transfer cylinders are typically blanket cylinders. Frequently, two such pairs of printing and transfer cylinders will be combined in such a manner that the transfer cylinders act as counter-pressure cylinders for each other and define a printing gap through which a sheet or web to be printed can pass. Such printing pair combinations are referred to as bridge printing units, because they bridge the printing gap. Often these bridge printing units will be arranged in vertical stacks or towers.

One prior arrangement of a rotary printing press which uses rubber blanket cylinders and plate cylinders is disclosed in European Patent Publication EP 0 644 048 A2 In this assembly these rubber blanket cylinders and plate cylinders are combined in pairs by utilization of mechanical couplings into cylinder groups which are commonly driven. Each such cylinder group is respectively driven by its own drive motor.

Such a prior rotary printing press requires mechanical devices for accomplishing the circumferential register of the various cylinders. Each cylinder group is separately adjustable since each is provided with its own drive motor. The units are not individually capable of being taken out of service, such as would be required to accomplish a plate change. The outlay for electrical equipment, such as for electric drive motors, for such a rotary printing press is relatively large.

It will thus be seen that a need exists for a printing device which overcomes the limitations of the prior art devices. The printing unit in accordance with the present invention provides such a device and is a significant improvement over the prior art.

SUMMARY OF THE INVENTION

It is an object of the present invention to provide a printing press.

Another object of the present invention is to provide an offset printing unit in a rotary press.

A further object of the present invention is to provide an offset printing unit having at least two printing cylinders and two transfer cylinders.

Still another object of the present invention is to provide a printing unit in which one of the printing cylinders and the two transfer cylinders have a common drive.

Yet a further object of the present invention is to provide a printing unit in which selectively one or the other of the printing cylinders is engageable with the two transfer cylinders.

As will be discussed in detail in the description of the preferred embodiment, which is presented subsequently, the printing unit in accordance with the present invention is provided with at least two printing cylinders and two transfer cylinders. One of the two printing cylinders and the two transfer cylinders are mechanically, interlockingly coupled to each other and all can be mechanically driven by a common drive. The other printing cylinder has its own drive and is not in interlocking drive connection with the transfer cylinder that is associated with it. Either of the drive motors for the first or the second printing cylinders can be mechanically coupled with the two transfer cylinders. The printing cylinder whose drive is not being used for the drive for the two transfer cylinders can be taken out of engagement with its associated transfer cylinder, such as would be required to accomplish a plate change.

The printing unit in accordance with the present invention eliminates much of the complex drive assemblies and register assemblies needed by prior devices. Mechanical devices for use in adjusting the circumferential register in the printing unit can be omitted. If the printing cylinder which is provided with its separate drive assembly undergoes a change in its circumferential register, this changes the phase positions of the two printing cylinders with respect to each other. However, there is no change in the relative angular positions between the two rubber blanket cylinders since the two blanket cylinders are in drive connection with the printing cylinder which remained stationary. The grooves or channels which extend axially across the rubber blanket cylinders, where the rubber blankets are attached to the cylinders, stay in the same position with respect to each other. The angular location of the groove or channel, in the printing cylinder which has been adjusted, changes with respect to the groove or channel of the associated rubber blanket cylinder. However, since the groove or channel of the printing cylinder, which constitutes a nonprinting area, is typically narrower than the groove or channel of the rubber blanket cylinder, the groove or channel of the plate cylinder whose circumferential register has been changed, does not extend outside of the area of the groove or channel on the associated rubber blanket cylinder. This means that the size of the non-printing area is not increased because of the existence of the grooves or channels on the rubber blanket cylinder, even if the circumferential register of the printing cylinder is changed.

In comparison with other printing units in which each cylinder has its own drive motor, the outlay for electrical equipment, such as drive motors and their associated controls, is substantially reduced in the present invention. In addition, it is also possible, because of the selective coupling of one or the other of the two printing cylinders to the two transfer cylinders, to shut down the printing cylinder which is not responsible for the drive itself as well as the two transfer cylinders. This will allow the non-driving printing cylinder to be taken out of service so that, for example, a plate change can be accomplished.

The printing unit in accordance with the present invention overcomes the limitations of the prior devices. It is a substantial advance in the art.

BRIEF DESCRIPTION OF THE DRAWINGS

While the novel features of the printing unit in accordance with the present invention are set forth with particularity in the appended claims, a full and complete understanding of the invention may be had by referring to the detailed description of the preferred embodiment, as presented subsequently, and as illustrated in the accompanying drawings, in which:

DETAILED DESCRIPTION OF THE PREFERRED EMBODIMENT

Figure 1:
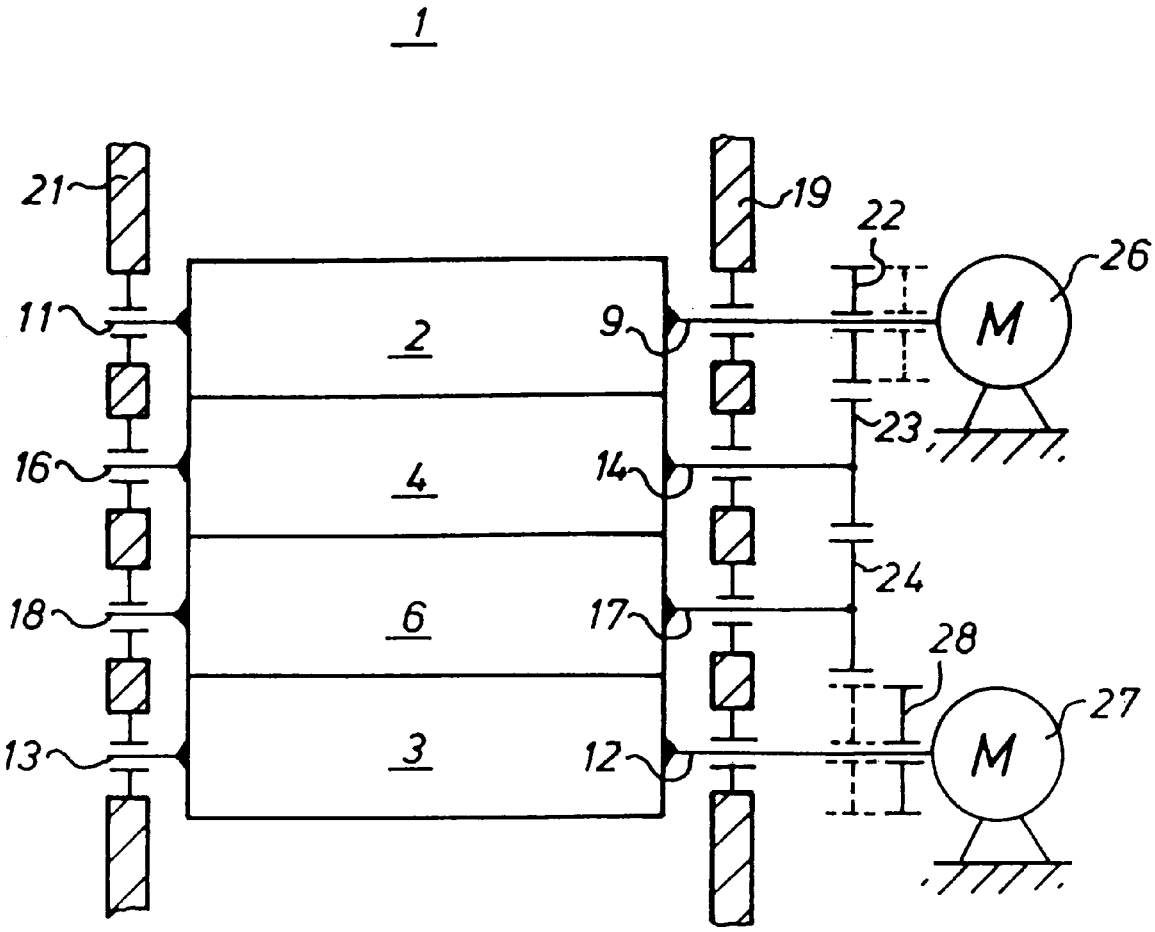
FIG. 1 is a schematic top plan view of a first printing unit in accordance with the present invention.
Figure 2:
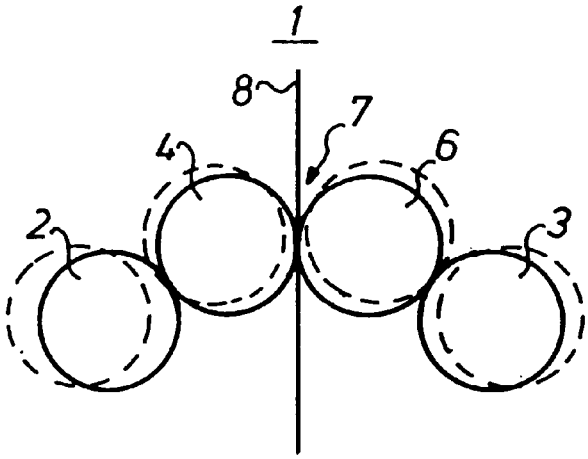
FIG. 2 is a schematic end view of the first printing unit.

Referring to FIGS. 1 and 2 there may be seen a schematic depiction of a printing unit, generally at 1, in accordance with the present invention. As depicted, printing unit 1 is an offset printing unit in which the various cylinders are arranged in so-called bridge construction. This printing unit 1 is essentially comprised of two printing cylinders 2 and 3 and two associated transfer cylinders 4 and 6. In the preferred embodiment, the printing cylinders 2 and 3 are plate cylinders while the two transfer cylinders 4 and 6 are rubber blanket cylinders. The plate cylinder 2 and the blanket cylinder 4 form a pair while the plate cylinder 4 and the blanket cylinder 6 form another pair. The two rubber blanket cylinders 4 and 6 have a contact zone or contact point which forms a printing location 7 in which a paper web 8 is printed on one or both sides.

These plate cylinders 2 and 3 and rubber blanket cylinders 4 and 6 are each provided at both ends with journals 9 and 11, 12 and 13, 14 and 16 and 17 and 18, respectively which are seated in lateral frames 19 and 21 of the offset rotary printing press. The plate cylinders 2 and 3 and the rubber blanket cylinder 4 and 6 are all arranged in a known manner, for example, by means of eccentric bushings, so that they can be shifted into and out of contact with each other. For example, the plate cylinders 2 and 3 can each be arranged to be in and out of contact in relation to their associated rubber blanket cylinder 4 or 6. On a drive side of the printing unit 1, the journals 9, 12, 14 and 17 of the plate and rubber blanket cylinders 2, 3, 4 and 6, respectively extend through the lateral frame 19. The journals 14 and 17 of the two rubber blanket cylinders 4 and 6 and journal 9 of the first plate cylinder 2 are all provided with cooperating gear wheels 22, 23 and 24, respectively as seen in FIG. 1. These three cylinders 2, 4 and 6 are cooperatively driven by a common drive 26, for example by a position-controlled electric motor 26. This electric motor 26 is connected directly to journal 9 of the first plate cylinder 2, for example, but the drive motor 26 can also be directly or indirectly connected to on any one of the three cylinder 2, 4, 6.

The second plate cylinder 3 is provided with its own drive 27, which may be, for example, a position-controlled electric motor 27. The drive 26 of the three cylinders 2, 4 and 6 and the drive 27 of the second plate cylinder 3 are synchronized with each other. Thus when both of the drive motors 26 and 27 are in operation, both of the plate cylinders 2 and 3 will be caused to rotate and will impart inked images to their respective blanket cylinders 4 and 6 which will print the paper web 8 as it passes through the printing location 7.

Figure 3:
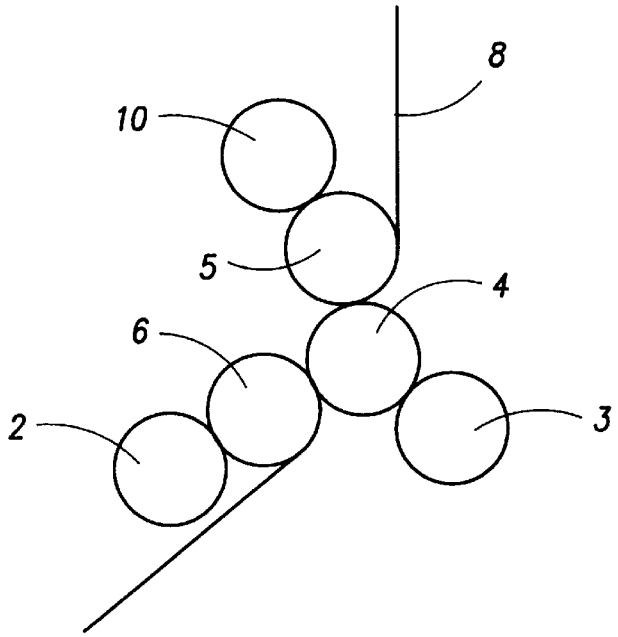
FIG. 3 is a schematic end view of a second embodiment of the printing unit in accordance with the present invention.
Figure 4:
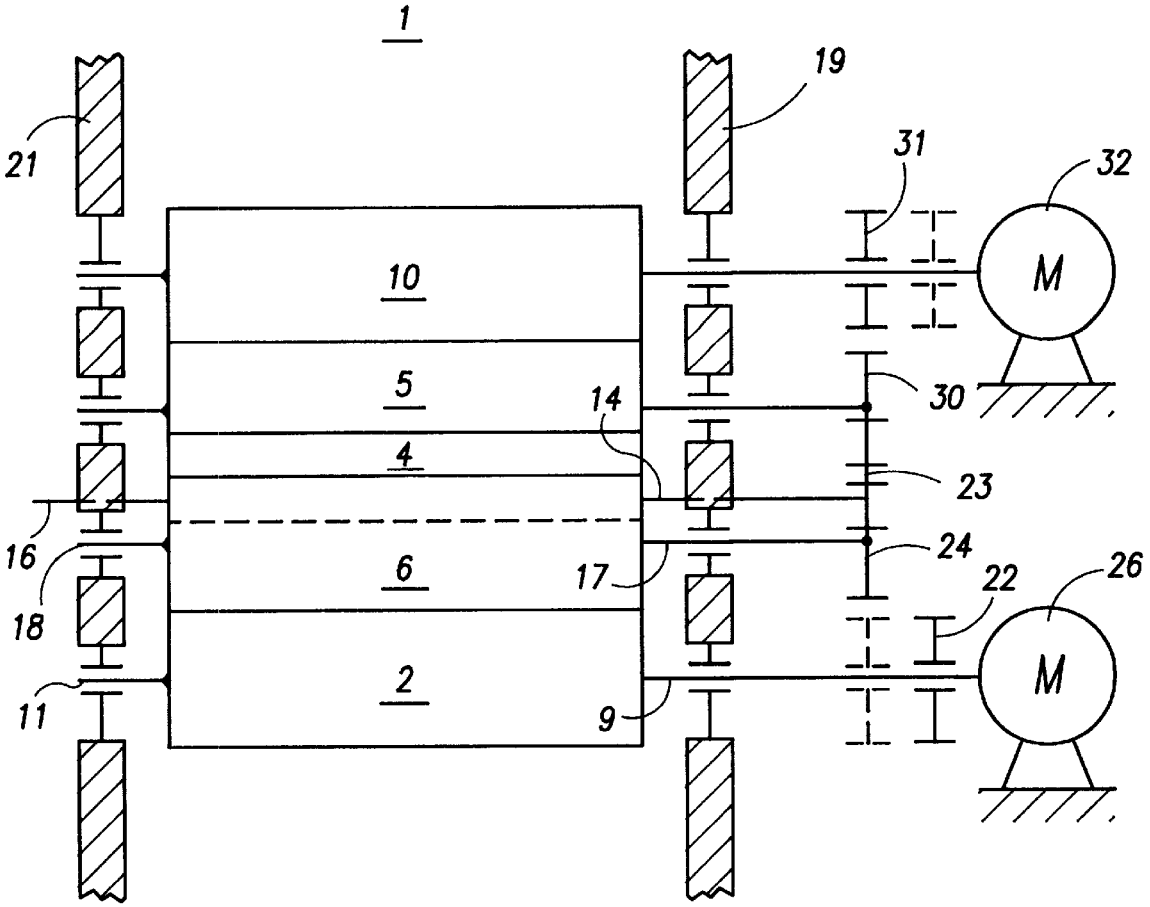
FIG. 4 is a schematic side elevation view of the second printing unit.

It is possible, in accordance with the present invention as seen in FIG. 3, to bring a third blanket cylinder 5 of a third pair of plate and rubber blanket cylinders which includes a third plate cylinder 10 into contact with one of the two rubber blanket cylinders 4 or 6. In this case, the third rubber blanket cylinder 5 forms a second printing location with the first or second rubber blanket cylinder 4 or 6. The third rubber blanket cylinder 5 is then also provided as seen in FIG. 4 with a gear wheel 30 which, for example, meshes with the gear wheel 23 of the cooperating rubber blanket cylinder 4. The third rubber blanket cylinder 5 is thereby coupled mechanically, for example interlockingly, with the first and second rubber blanket cylinders 4 and 6 as well as the first plate cylinder 2. The third plate cylinder 10 is also provided with its own gear wheel 31 with its own position-controlled electric motor 32, in a manner similar to the provision of second plate cylinder 3 with its own position-controlled electric motor 27.

In a further preferred embodiment which is not depicted in the drawings, the two rubber blanket cylinders 4 and 6 do not cooperate directly with each other. Instead, an additional printing cylinder, a so-called satellite cylinder, is provided. Each rubber blanket cylinder 4 and 6 then constitutes a separate printing location together with this printing cylinder with which it is in contact. This printing cylinder is preferably provided with a gear wheel, which meshes with a gear wheel of a rubber blanket cylinder with which it is associated. In this way, the printing cylinder is mechanically, for example interlockingly, coupled with a rubber blanket cylinder. It is also possible to provide the printing cylinder with its own independent drive, for example with a position-controlled electric motor.

The gear wheel 22 of the plate cylinder 2 can, for example, also be disconnectable from the gear wheel 23 of the associated rubber blanket cylinder 4. To this end, the gear wheel 22 can be seated so as to be axially displaceable on the journal 9 of the plate cylinder 2, as depicted in dashed lines in FIG. 1, so that it can be brought out of engagement with respect to the gear wheel 23 of the rubber blanket cylinder 4. It is also possible to arrange a gear wheel 28 on the journal 12 of the second plate cylinder 3, which gear wheel 28 can be brought selectively into engagement with the gear wheel 24 of the associated rubber blanket cylinder 6. To this end, the gear wheel 28 is axially displaceably seated on the journal of the plate cylinder 3, also as seen in dashed lines in FIG. 1. In this way, it is possible to selectively couple one of the two plate cylinders 2 or 3 mechanically to the two rubber blanket cylinders 4 and 6, i.e. to place either plate cylinder 2 or 3 into interlocking drive connection with rubber blanket cylinders 4 and 6, while the other plate cylinder 2 or 3 is disconnected from the rubber blanket cylinders 4 and 6. This second, disconnected plate cylinder 2 or 3 can then be brought out of contact with its associated rubber blanket cylinder 4 or 6, for example to perform a plate change, and can be shut down in this way, while the connected plate cylinder 2 or 3 prints the paper web 8 in cooperation with the two rubber blanket cylinders 4 and 6.

For the mechanical coupling, for example for the interlocking drive connection of the cylinders 2, 4 and 6, or 3, 4 and 6, it is also possible to provide other means, for example toothed belts, in place of the gear wheels 22, 23 and 24. These toothed belts could also be selectively cooperatively engaged so that either cylinders 2, 4 and 6, or alternately cylinders 3, 4 and 6 could be driven in a connected fashion.

While preferred embodiments of a printing unit in accordance with the present invention have been set forth fully and completely hereinabove, it will be apparent that a number of changes in, for example, the sizes of the cylinders, the types of printing plates used, and the like could be made without departing from the true spirit and scope of the present invention which is accordingly to be limited only by the following claims.

What is claimed is:

1. A printing unit comprising:

at least first and second printing cylinders;

a first transfer cylinder in contact with said first printing cylinder;

a second transfer cylinder in contact with said second printing cylinder and also with said first transfer cylinder;

a first drive means mechanically coupling said first printing cylinder and said first and second transfer cylinders for mutual operation; and a second drive means for said second printing cylinder, said second printing cylinder having no interlocking drive connection with said second transfer cylinder.

2. The printing unit of claim 1 further including a third printing cylinder and a third transfer cylinder, said third transfer cylinder being driven by said first drive means, and a third drive means for said third printing cylinder, said third drive means having no interlocking drive connection with said third transfer cylinder.

3. The printing unit of claim 1 wherein said first and second transfer cylinders are in direct contact and form a printing location.

4. The printing unit of claim 1 wherein said first and second transfer cylinders cooperate with one of said first and second printing cylinders.

5. The printing unit of claim 1 wherein said first printing cylinder and said first and second transfer cylinders are in interlocking drive connection.

6. A printing unit comprising:

at least first and second printing cylinders;

a first drive for said first printing cylinder, including a first printing cylinder drive gear and a first printing cylinder drive motor driving said first printing cylinder drive gear and first printing cylinder and a second drive for said second printing cylinder, including a second printing cylinder drive gear and a second printing cylinder drive motor driving said second printing cylinder drive gear and said second printing cylinder;

a first transfer cylinder in contact with said first printing cylinder and having a first transfer cylinder gear, said first transfer cylinder gear selectively engaging with said first printing cylinder drive gear;

a second transfer cylinder in contact with said second printing cylinder and having a second transfer cylinder gear, said second transfer cylinder gear selectively engaging with said second printing cylinder drive gear, said second transfer cylinder being in contact with said first transfer cylinder;

means for directly mechanically coupling said first and second transfer cylinders including said first and second transfer cylinder drive gears; and means for selectively bringing one of said first printing cylinder drive gear and said second printing cylinder drive gear into interlocking drive connection with a respective one of said first and second transfer cylinder gears to drive said one of said first and second printing cylinders and said first and second transfer cylinders.

* * * * *